United States Patent [19]

Hatfield

[11] 4,083,526

[45] Apr. 11, 1978

[54] PAPERBOARD TUBE CONCRETE FORMS

[75] Inventor: Hodge Hatfield, Wood River, Ill.

[73] Assignee: Alton Box Board Company, Alton, Ill.

[21] Appl. No.: 726,845

[22] Filed: Sep. 27, 1976

[51] Int. Cl.[2] ..... B28B 7/34; B28B 7/38

[52] U.S. Cl. ..... 249/48; 249/115; 249/134

[58] Field of Search ..... 264/338; 249/112, 114–115, 249/134, 48; 427/133; 106/38.25, 38.6

[56] References Cited

U.S. PATENT DOCUMENTS

| | | | |
|---|---|---|---|
| 1,394,255 | 10/1921 | Davis | 249/134 |
| 2,765,248 | 10/1956 | Beech et al. | 249/114 |
| 2,991,533 | 7/1961 | Reid et al. | 249/134 |
| 3,240,618 | 3/1966 | Hemming | 427/133 |
| 3,329,747 | 7/1967 | Veach | 249/48 |
| 3,468,690 | 9/1969 | Hemming | 427/133 |

*Primary Examiner*—J. Howard Flint, Jr.
*Assistant Examiner*—John McQuade
*Attorney, Agent, or Firm*—Paul M. Denk

[57] ABSTRACT

A paperboard tube for use in forming concrete columns is split longitudinally into two parts, with each part initially having its cut edges threated with a urethane resin, with each part then being dipped into a solution of an acrylic resin, and finally each part then having its interior surfaces coated with a urethane resin, each part is then assembled into a composite tube, and when used, having a reinforcing member arranged along the length of its longitudinal slits, for reinforcement of the tube edges, and finally a strap(s) or clamp(s) is arranged therearound so as to secure the tube into position for use in the pouring of concrete columns.

3 Claims, 6 Drawing Figures

PAPERBOARD TUBE CONCRETE FORMS

CROSS REFERENCE TO RELATED APPLICATION

The subject matter of this application is related to the subject matter of the invention disclosed in the U.S. Pat. No. 3,329,747, upon the process and form for making concrete columns, which patent is owned by a common assignee.

BACKGROUND OF THE INVENTION

This invention relates generally to the forming of concrete columns, and more particularly, pertains to the specialized treatment of a paperboard tube for use as a form in the pouring of concrete columns.

Various prior art disclosures reveal the use of paperboard tubes for functioning as forms for the forming of concrete, and more specifically, such forms had attained early use for this purpose as an inexpensive means for a disposable building component for use in the building trade. But, as can be readily understood, the use of wound paper tubes as concrete forms subjects the tube to an exposure of an abundance of moisture, as for example, when the poured concrete begins to set in a manner that urges its retained water to transfer either to the top or outwardly to the sides of the column form. As a result, paper tubes have heretofore not been very resistant against deterioration and decay when exposed to such excessive moisture conditions, which usually causes their delamination, and in certain cases, actual failure in supporting the heavy poured concrete.

To overcome such problems, early inventors gave consideration to the treatment of the paperboard tube for the purpose of achieving some sealing, or perhaps provide a moisture barrier lining of the tube component from direct exposure to the fresh concrete. For example, in the United States patent to Atkinson, U.S. Pat. No. 2,316,752, there is disclosed the treatment of surfaces of wooden forms, which also is intended to embrace paperboard type forms, with a surface treatment of a nitrocellulose, such as dipping the form into the lacquer solution. While the principle involved in this Atkinson patent is encouraging from the standpoint of providing some resistance, particularly in the case where a paperboard tube may be involved, as against exposure to moisture, the type of lacquer described in this patent during usage exhibits a very hard resinous interior surface for the form, and which surface could be easily damaged by the aggregate in the concrete, rendering the form very acceptable to on-site damage as by puncturing. The current invention has taken into consideration the type of treatment suggested by Atkinson, but that the treatment of paperboard or fiberboard with a nitro-cellulose as suggested in the Atkinson method was found to be in and of itself unsatisfactory in practice.

Other United States patents gave consideration to the use of a barrier against moisture penetration when utilizing paperboard tubes as concrete forms. For example, in a United States patent to Copenhaver, U.S. Pat. No. 2,677,165, the United States patent to Clarkson, U.S. Pat. No. 2,836,874, and the United States patent to Hart, U.S. Pat. No. 2,914,833, there is disclosed the concept of forming a spirally wound tube that includes an inner liner of a polyethylene film, which is primarily used for the purpose of preventing concrete adhesion to the innermost ply of the tube. The purpose of the teachings of these prior art patents was primarily to lend a quick release of the formed concrete from the interior of the paperboard tube column, and not so much from the standpoint of providing a water barrier for the tube itself, but the problem with these prior developments is that after the concrete column had been formed, and set, and the tube then rapidly removed from the column, the polyethylene liner itself at times had to be delicately stripped from the formed column, thereby necessitating an extra step in the process of forming poured concrete columns in this manner.

Other prior art disclosures gave consideration to the moisture proofing of various paper components, such as shown in the U.S. Pat. No. 3,454,207, to Jackson, which discloses a paperboard container useful for holding paints, which has an interior surface treated with a polyvinylidene chloride, for sealing purposes, and then applies a polyurethane coating to the same surface of the container to provide structural reinforcement. Obviously, the treatment of a container or can under Jackson's teachings are somewhat nonanalogous to the invention herein under consideration, but, the concept was at least present in providing some form of a treated interior surface for a container, at least through the use of a polyvinylidene chloride for the purpose of providing a moisture barrier, even though the urethane coating was applied principally for structural purposes, and not for moisture retarding or release functioning.

It is, therefore, in view of the prior art in existence respecting this invention to provide as its principle object a papertube that is particularly designed and contoured, and multi-coated, so as to provide for its fascile and quick usage in forming poured concrete columns.

Another object of this invention is to provide a paperboard tube which is split into particular configurations that facilitate its easy usage and assembly into a form for the constructing of concrete columns.

Another object of this invention is to provide a paperboard tube which is designed cut and coated at particular locations so as to furnish a moisture resistant form for pouring of concrete columns, and also to provide for a quick release of a paperboard tube from the concrete column after its setting.

Another object of this invention is to provide a particularly designed chemical solution for use in preventing delamination of paperboard tubes when exposed to high moisture conditions.

A further object of this invention is to furnish a quick release of paperboard tubes from concrete when used in forming multi shaped columns.

These and other objects will become more apparent to those skilled in the art upon reviewing the summary of this invention, and upon undertaking a study of the description of the preferred embodiment in view of its drawings.

SUMMARY OF THE INVENTION

This invention contemplates the use of a paperboard tube, of a proper laminated thickness, and one which is either spirally wound, but preferably convolutely wound, so as to furnish structural rigidity as when used in forming a concrete column. The paperboard tube formed in the foregoing manner is design split preferably along its length and usually into two parts, generally providing two longitudinal halves of the tube, so that said halves can be easily shipped in their knockdown form, and once again reassembled at the construction site into their tubular configuration and ready for reception internally of the properly arranged reinforcing steel and an ample quantity of poured concrete for assisting in forming a designed column.

Each tube part is initially coated along its cut edges with a urethane resin, and one which is moisture cured so as to provide a hardened edge for each tube part that provides significant resistance against delamination of the tube while either in storage, awaiting usage, or during usage itself, as when exposed to the heavy moisture content of poured concrete.

Urethane resin or coatings are available for this purpose, and exhibit the characteristics of having a high abrasion resistance, good flexibility, are readily resistant to any moisture, exhibit fast drying time, are good in adhesion, and certainly are weatherability. Urethane resins of this nature are generally formed as an isocyanate terminated prepolymer, and of the type that dries by its solvent evaporation, and then cures by its reaction with the moisture in the air. In addition, other types of polyisocyanates, usually as an adduct of diisocyanate and trimethylolpropane, as one component, and a polyol, such as a polyester, as the second ingredient. Upon mixing of these two components, which are commercially available, the solvents evaporate and the reaction proceeds at ambient conditions without the aid of a catalyst. In any event, liquified coatings of this nature can be used for moisture resistance purposes, and such can be acquired from companies such as B.F. Goodrich Chemical Company, of Cleveland, Ohio, Allied Chemical Corporation, of Buffalo, N.Y., and others.

Furthermore, each tube part is coated upon its entire interior and exterior surfaces with an acrylic water base emulsion that contains resin solids in the vicinity of 25%, even though an acrylic resin solution containing anywhere from fifteen to forty percent of resin solids have been found satisfactory for the purposes of this invention. Preferably, and to expedite the fabrication of these tubes for their intended purposes, the acrylic resin coating will be applied by a dipping of each entire half tube into a quantity of the solution, and then allowing said dipped tube parts to be either air dried from approximately 18 to 20 hours, or accelerated drying by exposing the parts to a warm air flow.

The acrylic water base emulsion utilized in this step of the process of preparing the paper column for its use are generally available upon the market, for example, one such product may be obtained from S.C. Johnson & Son, Inc., of Racine, Wis., under the name Joncryl 67 Acrylic Resin. A similar type product may be acquired from the same Company under the name Versacryl, which is essentially another form of acrylic coating that is very effective as a sealer, even to wound paper tubes.

Finally, the inside exposed areas of each tube part, and particularly those areas that will be exposed to the wet concrete, is coated with the aforesaid urethane solvent coating, and once again allowed to dry before shipment.

The addition of a urethane solvent coating upon the inside exposed areas of the tube halves is primarily for the purpose of furnishing a prompt and full release of the form from the set concrete. Such release materials generally include a urethane resin as a coating, and other types of polymeric coatings that form a release coat are also readily available upon the market, such as the one identified under the name Butalite, and which may be acquired from Products Research & Chemical Corporation, of Addison, Ill.

At the job site, each tube part, assuming that each tube will be severed into two halves, may be assembled together at the location where a column is desired, such assembly either being made around the pattern arranged reinforcing steel that will be eventually embedded for tensile strength within the poured concrete column, or perhaps even have reinforcing steel inserted within the paperboard tube after it has been erected in place. In any event, when a pair of the tube halves, or parts, are brought together into a composite column, a reinforcing member, such as a length of wood, is arranged contiguous along the length of each side seam or split previously made longitudinally of the tube, so as to provide a reinforcement for the composite tube at these locations. And finally, a clamping means or strap such as in the manner as shown in the earlier defined Veach U.S. Pat. No. 3,329,747, may be disposed around the composite tube so as to provide for its structural integrity and retention into its tube configuration as when the heavy wet concrete is poured into the form for creating a column.

DESCRIPTION OF THE PREFERRED EMBODIMENT

Figure 1:
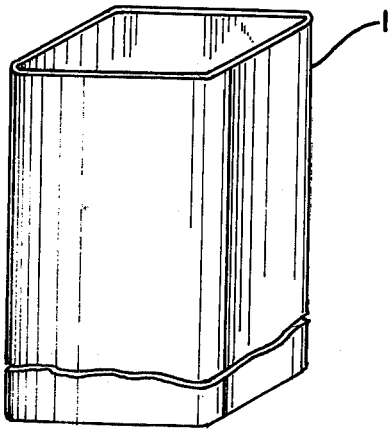
FIG. 1 discloses a square paperboard tube as originally wound for use for the purposes of this invention.
Figure 2:
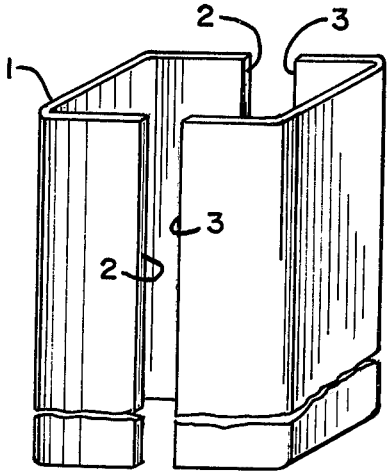
FIG. 2 discloses the paperboard tube of FIG. 1 being split longitudinally into at least two tube parts for use for the purposes of this invention.

In referring to the drawings, and in particular FIG. 1, there is shown a wound paper tube, being rather rectangular or square in shape, and having some radius formed at its corners, so as to provide a rather symetrically formed tube that will furnish, interiorly, the designed shape desired for the concrete column, or columns, as architecturally specified. The wound paper tube 1, as shown, will be formed to those lengths dictated by the mandrel available for the original winding of the tube itself, generally under the convolute winding process, with lengths usually in the vicinity of four and five feet being readily available in the trade. As can be seen in FIG. 2, the length of tube is split longitudinally so as to expose cut edges, as at 2 and 3, generally at diametrically opposite sides of the tube. In this manner, the tube can be more easily assembled in place, at the site of usage, after the reinforcing steel has been erected as specified. But of additional importance is the face that a tube split in this manner can be more easily shipped, in its knockdown state, thereby reducing the high cost of transportation that adds significantly to the cost of current day construction.

Figure 3:
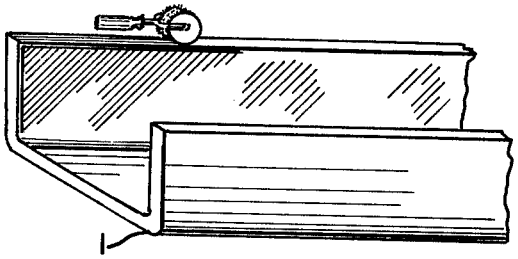
FIG. 3 discloses the edge treatment made to the cut edges of the tube so as to reinforce the same against delamination when exposed to moisture.
Figure 4:
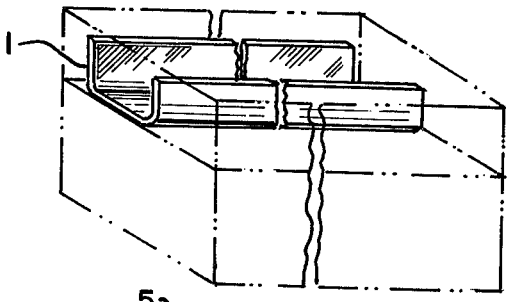
FIG. 4 discloses a tube part being dipped into an acrylic resin solution so as to seal its surface pores against moisture penetration.

FIG. 3 discloses that step in the process for forming the specific concrete column of this invention wherein the slit edges of the wound papertube are initially coated with a moisture sensitive urethane solvent coating for the purpose of sealing these exposed edges against moisture absorption. Hence, as previously commented, delamination of the papertube at these locations is effectively resisted. Then, each entire half of the cut tube is coated, as by a dipping process, as disclosed in FIG. 4, by submerging the tube into an acrylic water base emulsion as previously identified. After exposing the entire tube half to the acrylic solution, each tube section is then dried for a specified number of hours so as to provide an adequate and hard seal against moisture absorption into the paper, and effectively resist its further decomposition as when used and exposed to fresh concrete. Normally, 18 to 20 hours are required to achieve an effective ambient drying of the tube halves, although such drying time may be reduced by exposing the treated tube to a warm air flow. Finally, the interior surfaces of the tube section, or particularly those surfaces that will be directly contacted by concrete, are once again coated with the moisture sensitive urethane solvent coating, of the types previously analyzed in the summary of this invention, which then provides a tube section that is ready for its intended purpose.

Figure 5:
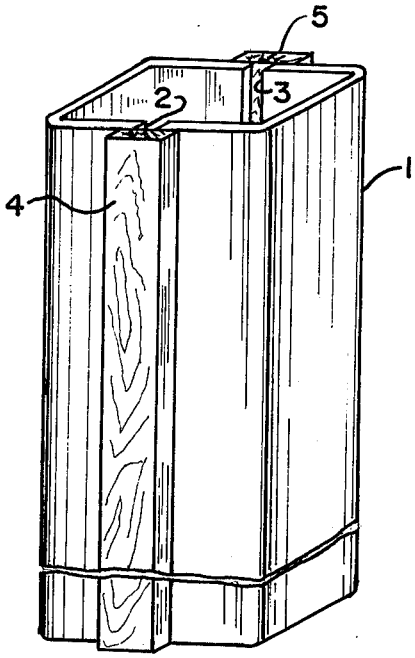
FIG. 5 discloses a pair of tube parts being assembled with their reinforcing means into the configuration of a composite form.
Figure 6:
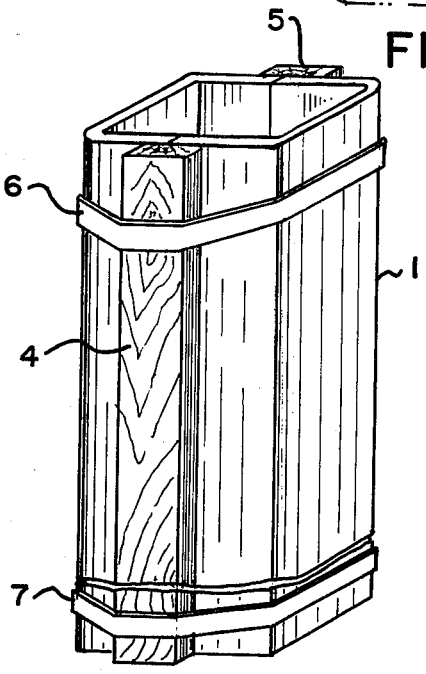
FIG. 6 discloses the composite of paperboard tube formed and strapped into position for functioning as a form incident to the pouring of a concrete column.

During usage, a pair of tube sections, and preferably the complimentary sections that had initially been cut from a single tube, are brought together into paired fashion to once again form their rectangular configuration, as in cross section, and a reinforcing means, such as lengths of 2×4 inches, as at 4 and 5, or other structure, are rested against the outer peripheries of the cut edges of the longitudinal tube, and then strapped in place, as by the strap 6 and 7, so as to form an integral structure that is ready for the reception of a specified quantity of concrete. The initial assembly step is shown in FIG. 5 of the drawings, while the finally assembled tube, which is ready for the reception of poured concrete, is disclosed in FIG. 6.

Other variations upon the invention disclosed herein may occur to those skilled in the art upon reviewing the subject matter of this invention. Such variations, if within the spirit and scope of this invention, and encompassed by the claims appended hereto, are intended to be protected by any United States patent issuing upon this invention. The disclosed preferred embodiment is set forth for illustrative purposes only.

I claim:

1. A paperboard tube for use in forming concrete columns, said tube being split longitudinally into at least two parts and thereby forming a pair of longitudinally arranged cut edges on each part, the cut edges on each tube part having a urethane coating initially applied thereto so as to prevent moisture absorption thereat and its consequent delamination, each tube part having a coating of acrylic resin thereon to seal its surface pores and prevent moisture absorption, a third coating of urethane solvent applied to at least the interior surface of each tube part to facilitate the release of the composite tube parts after forming a concrete column.

2. The invention of claim 1 wherein said tube parts are arranged together into a composite paperboard tube, reinforcing means arranged contiguous the aligned cut edges and overlapping the same to insure their retention together, and a strap means securing the tube parts and reinforcing means together into the composite tube for forming a concrete column.

3. The invention of claim 1 wherein the acrylic resin comprises a 25% solution of resin solids.

* * * * *